US009518505B2

(12) United States Patent
Matthews et al.

(10) Patent No.: US 9,518,505 B2
(45) Date of Patent: Dec. 13, 2016

(54) COOLANT JACKET FOR A TURBOCHARGER OIL DRAIN

(71) Applicant: Ford Global Technologies, LLC, Dearborn, MI (US)

(72) Inventors: Patrick Matthews, West Bloomfield, MI (US); Robert Andrew Wade, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 756 days.

(21) Appl. No.: 13/711,557

(22) Filed: Dec. 11, 2012

(65) Prior Publication Data

US 2014/0157773 A1 Jun. 12, 2014

(51) Int. Cl.

| | |
|---|---|
| ***F02B 33/44*** | (2006.01) |
| ***F04B 17/00*** | (2006.01) |
| ***F02B 37/00*** | (2006.01) |
| ***F02B 39/00*** | (2006.01) |
| ***F02B 39/14*** | (2006.01) |
| *F01D 25/12* | (2006.01) |

(52) U.S. Cl.

CPC ..... *F02B 37/00* (2013.01); *F02B 39/005* (2013.01); *F02B 39/14* (2013.01); *F01D 25/125* (2013.01); *F01P 2060/12* (2013.01); *F05D 2220/40* (2013.01)

(58) Field of Classification Search

CPC ..... F02B 37/00; F02B 39/14; F02B 39/005; F01D 25/125; F01P 2060/12; F05D 2220/40

USPC ..... 60/605.3; 417/406, 407

See application file for complete search history.

(56) References Cited

U.S. PATENT DOCUMENTS

| | | | | |
|---|---|---|---|---|
| 3,673,798 | A * | 7/1972 | Kuehl | 60/605.1 |
| 3,948,052 | A * | 4/1976 | Merkle | F02B 37/02 60/605.1 |
| 4,716,735 | A * | 1/1988 | Ruf | F02B 39/005 60/605.3 |
| 4,784,586 | A * | 11/1988 | Ho | F01D 21/00 417/407 |
| 4,813,408 | A | 3/1989 | Katsumoto et al. | |
| 4,907,952 | A * | 3/1990 | Inoue | F01D 25/125 417/407 |
| 4,927,336 | A * | 5/1990 | Rossmann | F01D 25/18 60/605.3 |
| 4,979,881 | A * | 12/1990 | Gutknecht | 417/407 |
| 5,079,921 | A * | 1/1992 | McCandless | F02B 37/186 60/602 |

(Continued)

FOREIGN PATENT DOCUMENTS

JP 07150962 A * 6/1995

*Primary Examiner* — Thai Ba Trieu
*Assistant Examiner* — Ngoc T Nguyen
(74) *Attorney, Agent, or Firm* — Julia Voutyras; Alleman Hall McCoy Russell & Tuttle LLP

(57) ABSTRACT

A system including a turbocharger, comprising a turbocharger bearing housing supporting a turbocharger drive shaft; an oil drain including an inlet in fluidic communication with the turbocharger bearing housing and an outlet in fluidic communication with an oil sump; and a coolant jacket enveloping the oil drain. The coolant jacket envelopes the oil drain and is positioned to provide coolant to the turbocharger bearing housing and draw heat from the oil draining through the oil drain to prevent coking of hot oil within the oil drain.

19 Claims, 5 Drawing Sheets

(56) References Cited

U.S. PATENT DOCUMENTS

| | | | | |
|---|---|---|---|---|
| 5,145,334 | A * | 9/1992 | Gutknecht | F01D 25/164 417/407 |
| 5,224,853 | A * | 7/1993 | Kazuo | F02B 37/18 60/602 |
| 6,305,168 | B1 * | 10/2001 | Furukawa | F02B 67/10 60/605.1 |
| 6,915,634 | B2 * | 7/2005 | Dumas | F02B 37/007 60/605.3 |
| 7,649,118 | B2 | 1/2010 | Araki et al. | |
| 7,819,227 | B2 * | 10/2010 | Rutschmann et al. | 184/6.5 |
| 2009/0320471 | A1 * | 12/2009 | Palazzolo | F02B 39/005 60/624 |
| 2010/0284824 | A1 * | 11/2010 | Hippen et al. | 417/44.1 |
| 2010/0296920 | A1 * | 11/2010 | Koch | F02B 39/005 415/180 |
| 2011/0195620 | A1 * | 8/2011 | Davis | B63H 20/14 440/75 |
| 2011/0253092 | A1 | 10/2011 | Springer et al. | |
| 2011/0296920 | A1 | 12/2011 | Niese | |
| 2012/0055424 | A1 * | 3/2012 | Kuhlbach | F02B 33/44 60/605.3 |
| 2013/0092108 | A1 * | 4/2013 | Mehring | F01M 5/001 123/41.72 |
| 2014/0056721 | A1 * | 2/2014 | Garrard et al. | 417/44.1 |

* cited by examiner

COOLANT JACKET FOR A TURBOCHARGER OIL DRAIN

TECHNICAL FIELD

The present disclosure relates to turbochargers for internal combustion engines.

BACKGROUND AND SUMMARY

Engines may use a turbocharger to increase engine torque/power output density. In one example, a turbocharger may include a compressor and a turbine connected by a drive shaft, where the turbine is coupled to the exhaust manifold side and the compressor is coupled to the intake manifold side. In this way, the exhaust-driven turbine supplies energy to the compressor to increase the flow of air into the engine.

In one example configuration, the drive shaft arranged between a compressor wheel and a turbine wheel is rotatably mounted in corresponding rotor bearings on the turbine side and the compressor side. The rotor bearings can generally be sliding bearings or roller bearings with oil lubrication, for example engine oil. The engine oil may be conducted to the individual bearing points via a pressure line, for example. The lubricant can both lubricate and cool the bearings.

The inventors herein have recognized potential pitfalls with the above-described oil lubrication system. For example, heat flux near the turbocharger may affect the oil supply and/or oil drain of the turbocharger. An increased heat flux can result in overheating and associated carbonization or coking of the lubricating oil, clogging the supply and/or drain, and thus reducing turbocharger lubrication. As the turbocharger operates at high rotational speeds, reduced lubrication can result in bearing degradation, thus reducing engine performance. Further, coking may occur at various locations, including in the bearings, which can also degrade performance.

In one particular example where the turbocharger is mounted in the valley of a V-type engine with inboard exhaust conduits. The turbocharger bearing oil supply and oil drain may be within the valley and the oil drain may be narrow as it leads between the cylinder heads and exhaust conduits. The narrow passage may be particularly susceptible to oil coking. Build up of residues within this drain can restrict the line, further inhibiting lubrication of the turbocharger.

In one embodiment, the present disclosure provides a coolant jacket for a turbocharger oil drain that draws heat away from hot oil as it drains out of the turbocharger, reducing the temperature of the oil and mitigating oil coking.

In another example, the present disclosure presents a system including a turbocharger, comprising a turbocharger bearing housing supporting a turbocharger drive shaft; an oil drain including an inlet in fluidic communication with the turbocharger bearing housing and an outlet in fluidic communication with an oil sump; and a coolant jacket enveloping the oil drain. The coolant jacket is suitable to provide coolant to the turbocharger bearing housing and to draw heat from the hot oil within the oil drain as it exits the turbocharger. In this way, the oil drain cooling jacket can also perform the feeding of coolant to the turbocharger bearing housing, thereby eliminating at least one external coolant line to the turbocharger. Within the valley of a V-type engine space for tubing may be limited, because of this, the oil drain may be narrow and cooling the hot oil in the narrow oil drain reduces the possibility of oil coking which can result in residue build up and restriction of the drain.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
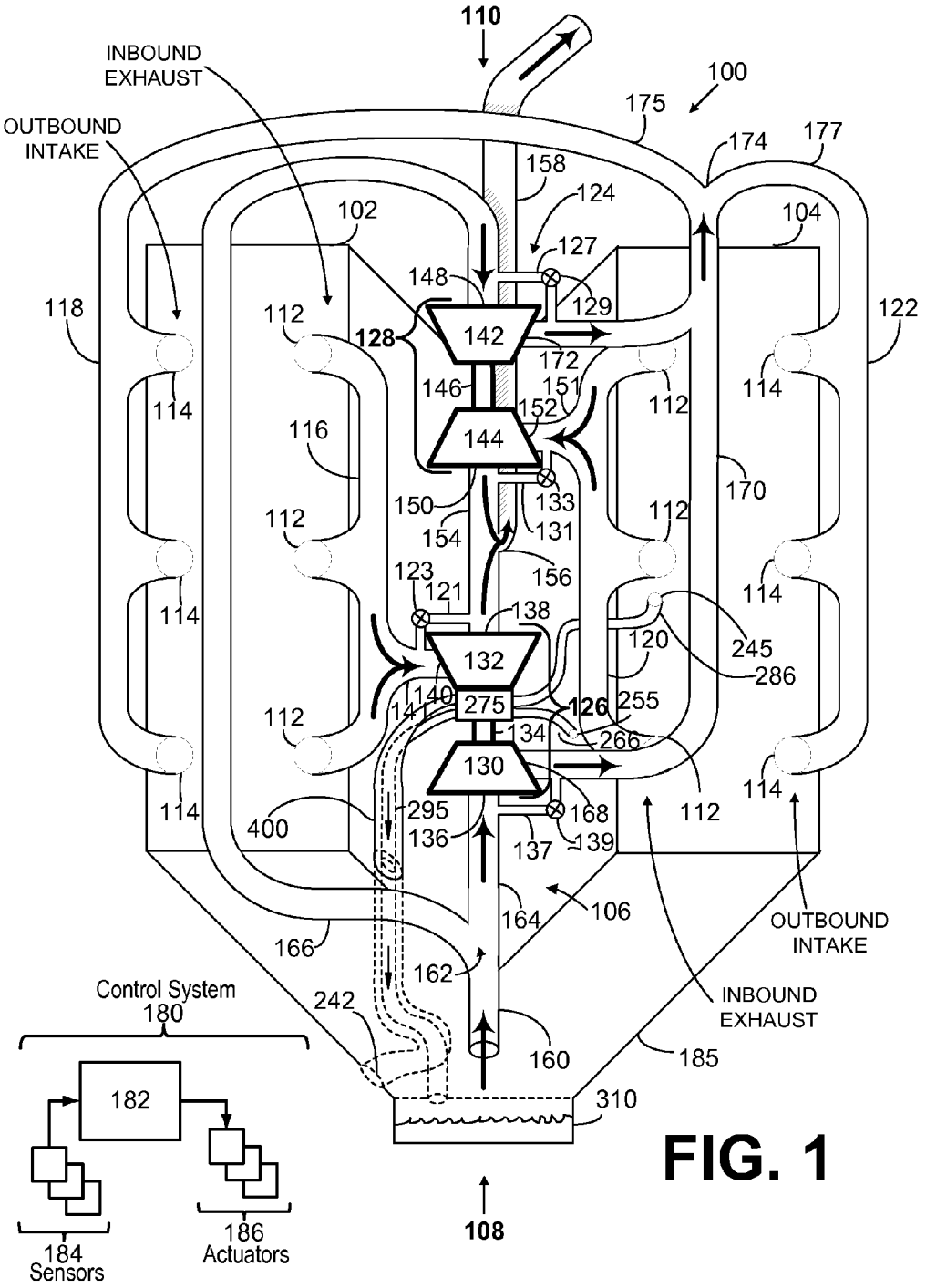
FIG. 1 shows a schematic top view of an engine with a central turbocharger arrangement.

The present disclosure details a coolant jacket for an oil drain of a turbocharger. The coolant jacket is suitable to draw heat from oil as it leaves the turbocharger. The oil used in the turbocharger functions as lubrication and coolant for rapidly spinning components. Oil within the turbocharger is exposed to high heat because of the rapid spinning of the turbine, the drive shaft, and the compressor impellor and also the heat of exhaust gases used to propel the turbine. This high heat can result in coking of lubricating oil which leaves damaging residues on turbocharger components and decreases lubricating abilities within the turbocharger. Providing a coolant jacket for a turbocharger oil drain, in parts, or along its entirety may mitigate coking within the narrow oil drain. Coking within the oil drain may cause restrictions and further inhibition to turbocharger lubrication. This may be especially relevant in turbochargers mounted in the valley of V-type engines where the oil drain passes between exhaust manifolds into the engine block where it drains into the oil sump. Because of this limit on space the oil drain of such a V-type engine may be small in diameter and thusly may be more susceptible to oil coking. In addition to the prevention of coking with the oil drain, a coolant jacketed oil drain has the effect of reducing oil temperature and may increase cooling capacity of oil that is re-circulated to the turbocharger or other engine components. Furthermore this coolant jacket may be configured to supply coolant to the turbocharger bearing housing, and the engine block coolant system. The coolant jacket may, in some embodiments, extend the length of the oil drain, whereas in other embodiments it may be advantageous to provide a coolant jacket only for segments or specific regions of the oil drain.

Cooling is highly significant, in particular in the case of the turbine-side bearing, since a significant quantity of heat is conducted into the shaft by the hot turbine wheel. If uncontrolled this high heat can result in overheating of the lubricant oil and an associated carbonization of the lubricating oil remaining in the exposed parts of the bearings, as a result of the subsequent heating of the shaft which is caused by the hot turbine. The carbonization of the lubricating oil may cause the rotor bearings to be covered in soot, which may cause turbocharger damage by means of altered balance in components spinning at high speeds or in the accumulation of residues that may result in wear on metallic components. Additionally, if the lubricating oil has overheated, forming coking residues on turbocharger components, less lubrication is available to these components and more heat is produced from increased friction resulting in further coking and damage.

The pressure fed oil used to lubricate and cool conventional turbochargers drains into a sump. A particular problem in turbochargers mounted in the valley of V-type engines is that the oil drain may be narrow as it leads between the cylinder heads and exhaust conduits. The narrow passage is particularly susceptible to oil coking. Build up of residues within this drain pipe can restrict the line, further inhibiting lubrication of the turbocharger.

Figure 2:
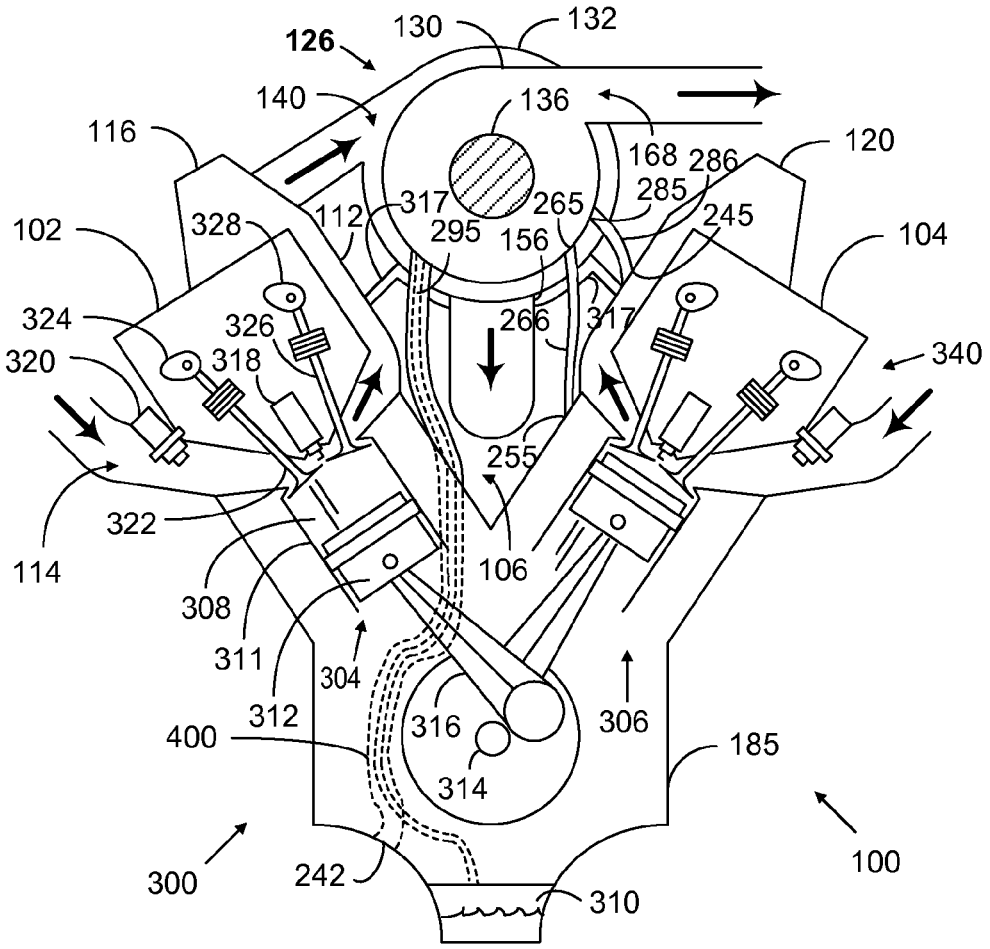
FIG. 2 shows schematic side views of a central turbocharger arrangement.
Figure 3:
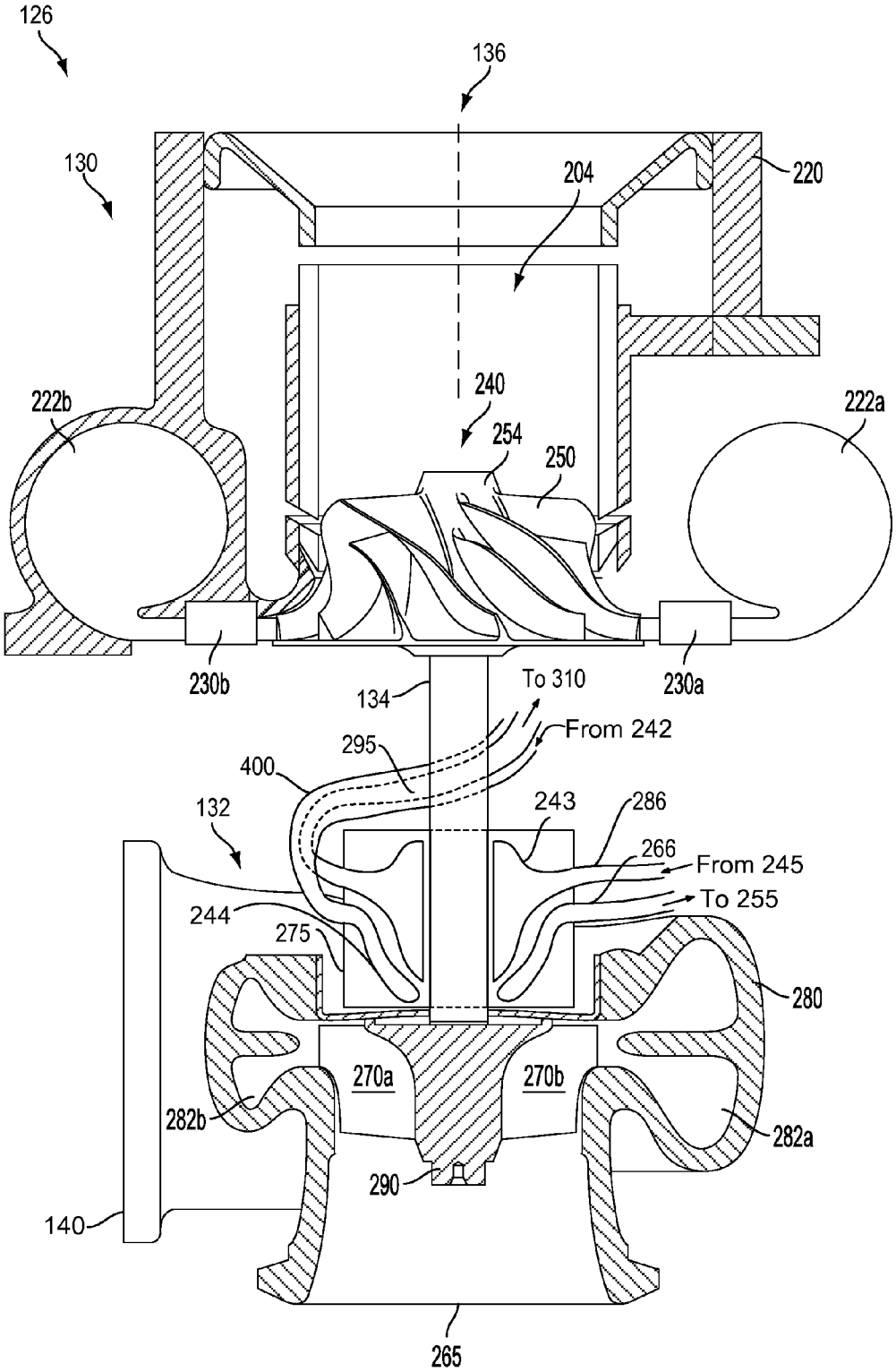
FIG. 3 shows a cut-away view of a turbocharger having a compressor and a turbine.
Figure 4:
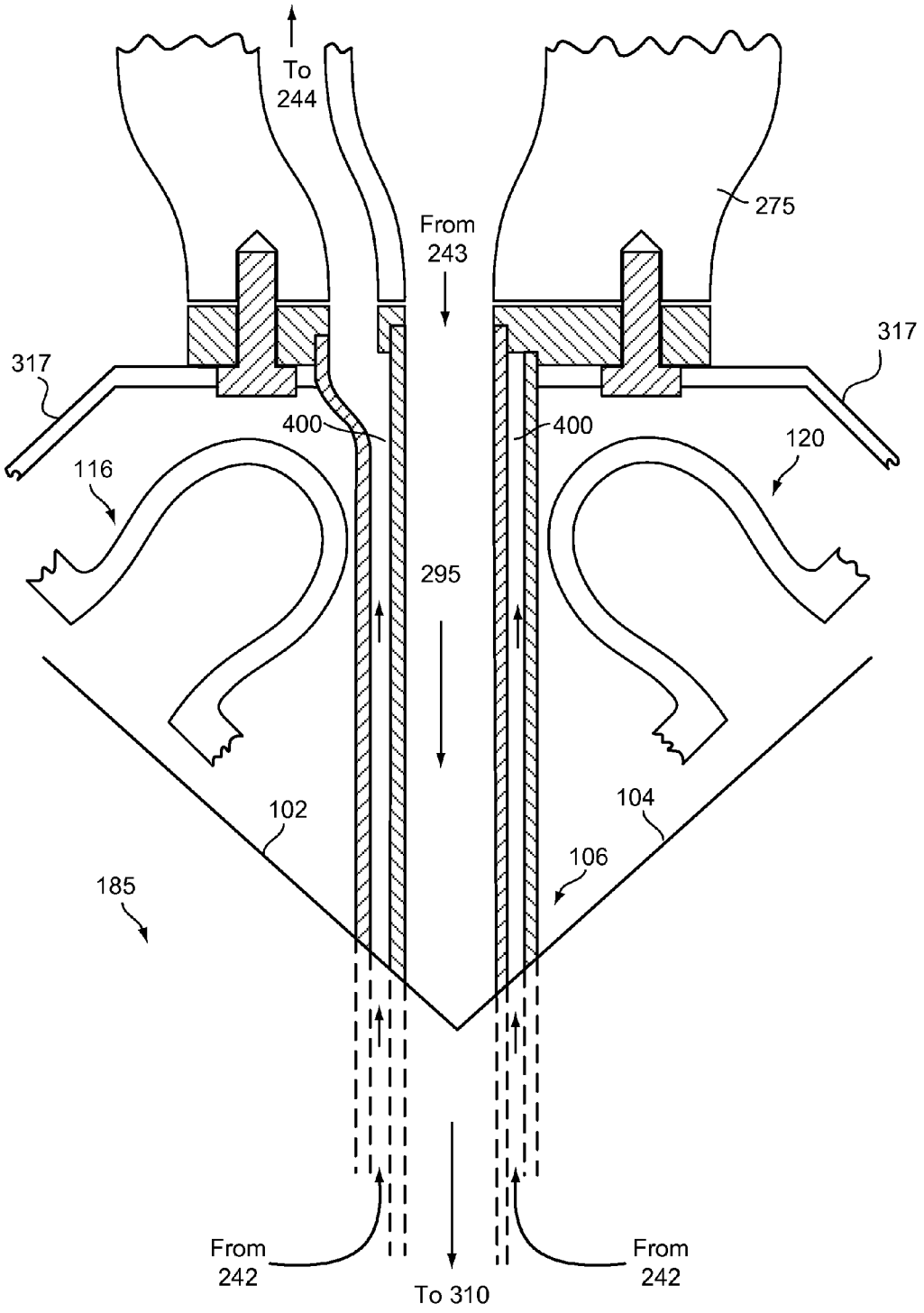
FIG. 4 shows a cut-away view of a coolant jacket for a turbocharger oil drain of the present disclosure.

Turning now to the figures in detail, FIG. 1 shows a schematic top-view of an example V-type engine 100 with a central turbocharger arrangement 124 positioned between the banks 102 and 104 of the engine. FIG. 2 shows a view of engine 100 from a first end 108, e.g. from a front end. In FIGS. 1-2, bold arrows indicate the direction of air or exhaust flow through the various passages in engine 100. FIG. 3 shows a turbocharger with associated turbine and compressor that could be mounted in the valley of V-type engine 100. FIG. 4 details a coolant jacket for a turbo charger oil drain of the present disclosure.

In FIG. 1 as described above, engine 100 may be configured so that the cylinders and pistons are aligned in two separate planes or "banks" forming a "V" shape when viewed along the axis of the crankshaft 314 (shown in FIG. 2). FIG. 1 shows an engine block 185 housing a first bank 102 on a first side of the engine and a second bank 104 on a second side of the engine. The banks may intersect forming a valley 106 between the banks. The valley 106 forms a central space in the engine between the banks and recessed from a top portion of the banks. Furthermore, engine 100 has a first end 108 (e.g., a front end) and an opposed, second end 110 (e.g., a back end) in a direction parallel to crankshaft 314 (shown in FIG. 2) of engine 100.

The first and second banks each include a plurality of cylinders with corresponding exhaust ports 112 and intake ports 114 disposed along heads 340 of the cylinders. Two example cylinders are shown in detail in FIG. 2 and described in more detail below herein. It should be appreciated that though the example engine in FIG. 1 shows a V-6 engine, the banks may include any number of cylinders. For example, engine 100 may be a V-4, V-8, or V-12 engine, among others. Furthermore, a turbocharger need not be mounted in a V-type engine and could be included in an inline engine or other engine configuration. Additionally, FIG. 1 depicts an engine 100 with two turbochargers, one for each engine bank, the coolant jacket for the turbocharger oil drain of the present disclosure is applicable in engine embodiments with any number of turbochargers.

Inbound cylinder exhaust ports 112 located on the banks of engine 100 may be positioned on sides of the cylinder heads 340 (shown in FIG. 2) adjacent to the valley 106. Outbound cylinder intake ports 114 may be positioned adjacent to sides of the cylinders heads 340 opposed to the sides facing the valley. In this way, exhaust exiting the cylinders may be directed to turbines positioned between the banks with a reduced amount of ducting. Alternatively, the cylinder exhaust ports may be positioned adjacent to sides of the cylinder heads opposed to the sides facing the valley while the intake ports may be positioned on sides of the cylinder heads adjacent to the valley. However, in the latter scenario, a greater amount of ducting may be required to couple the outlets of the exhaust manifold to the inlets of the turbines located between the banks of the engine.

The first bank 102 includes an inbound exhaust manifold 116 coupled to the exhaust ports 112 and an outbound intake manifold 118 coupled to the intake ports 114 on the first bank. The second bank 104 includes an inbound exhaust manifold 120 coupled to the exhaust ports 112 and an outbound intake manifold 122 coupled to the intake ports 114 on the second bank. The inbound exhaust manifolds may be positioned adjacent to sides of the banks facing toward the valley of the engine. In one example, the exhaust manifolds may be integrated into the cylinder heads on the banks, where the multiple exhaust ports feed into a single conduit forming the manifold. In another example, separate manifolds and heads may be used. Furthermore, the exhaust manifolds may be cooled by a variety of methods. For example, the manifolds may be water-cooled.

The exhaust manifolds may be oriented with outlets of the manifolds facing toward the space between the banks of the engine. Further, an outlet of a given exhaust manifold may be adjacent to an end of the given exhaust manifold. For example, exhaust manifold outlet 141 may be adjacent to an end of exhaust manifold 116 at end 108 of the engine. Likewise, exhaust manifold outlet 151 may be adjacent to an end of exhaust manifold 120 at end 110 of the engine. Further, outlets of the first and second exhaust manifolds may be adjacent to opposing first and second ends, respectively, of the engine. For example, an outlet of exhaust manifold 116 may be adjacent to end 108 while an outlet of exhaust manifold 120 may be adjacent to opposing end 110 of engine 100. The outlets 141 and 151 of the exhaust manifold may be directly coupled to inlet 140 of a turbine 132 and inlet 152 of a turbine 144, respectively, positioned between the banks of the engine. The central turbocharger arrangement 124 includes a first turbocharger 126 positioned between the banks and above the valley of engine 100 adjacent to the first end 108, and a second turbocharger 128 positioned between the banks and above the valley of engine 100 adjacent to the second end 110. Turbochargers 126 and 128 may be arranged in parallel, with one turbocharger assigned to each cylinder bank. For example turbocharger 128 may be assigned to bank 104 and turbocharger 126 may be assigned to bank 102. Assignment of a turbocharger to a given bank may include coupling the compressor output of the turbocharger with the intake manifold on the given bank and coupling the turbine input of the turbocharger with the exhaust manifold on the given bank. Such a configuration may simplify plumbing as compared with a single turbocharger configuration in which a single turbocharger is assigned to both banks of the engine. Further, the two turbochargers may be positioned directly above valley 106 so that there is a space formed between the turbochargers and a trough of the valley 106 of the engine.

The first turbocharger 126 includes a compressor 130 and a turbine 132 connected by a shaft 134. Shaft 134 may be positioned in a direction parallel to the crankshaft, for example. Shaft 134 is supported by bearings in turbocharger bearing housing 275. The bearing housing contains coolant and oil reservoirs (shown in FIG. 3). The oil reservoir is fed via an oil passage 286. The oil passage is fluidically coupled to the oil circuit of the cylinder block (not shown). Oil leaves the oil circuit within engine block 185 and enters oil passage 286 at oil inlet 245 where it is fed into the turbocharger 126 at bearing housing 275 to cool and lubricate spinning components. The oil exits the turbocharger 126 via oil drain 295 that is in fluidic communication with oil sump 310.

A single turbocharger bearing housing and its associated coolant and oil passages are shown on FIG. 1 for clarity. However, it should be understood that each turbocharger in an engine is provided with oil and coolant and has a housing and reservoir system for cooling and lubricating bearings and other movable components and these elements are substantially similar on turbocharger 128 but omitted from FIG. 1 for clarity.

The turbocharger is also supplied with coolant via the coolant jacket 400 that enters the cylinder block at coolant jacket inlet 242. The coolant jacket 400 of the present disclosure envelopes the oil drain drawing heat from the hot oil within the oil drain as it flows opposite the oil to cool the bearings within bearing housing 275. The coolant exits the turbocharger via coolant passage 266. The coolant passage 266 is fuidically coupled to the coolant system of the engine 100 and enters the engine block 185 at coolant passage outlet 255. The coolant jacket 400 may be fed via a pump with an additional line (not shown) entering at coolant inlet 242.

A single example of the coolant and oil passages is shown in FIG. 1, however the coolant jacket 400 may only partially envelope oil drain 295 either in circumference or in various regions along the length of the oil drain. Additionally, oil passage 286 and coolant passage 266 may enter the engine block 185 in varied orientations or different regions. Moreover, the coolant passage outlet 255 and oil passage inlet 245 may be located in an opposite engine bank of the V-type engine. In another example, coolant passage 266 may not enter the engine block 185 to join the coolant system for engine 100 and may be part of an isolated turbocharger coolant system.

The compressor and turbine of first turbocharger 126 may be oriented so that an inlet 136 of compressor 130 faces the first end 108 and an outlet 138 of turbine 132 faces the second end 110.

The second turbocharger 128 includes a compressor 142 and a turbine 144 connected by a shaft 146. Shaft 146 may be positioned in a direction parallel to the crankshaft, for example. The compressor and turbine of second turbocharger 128 may be oriented so that an inlet 148 of compressor 142 faces the second end 110 and an outlet 150 of turbine 144 faces the turbine outlet 138 of the first turbocharger. As described above this turbocharger also contains a bearing housing and associated coolant and oil passages and drains that have been omitted from the drawing for clarity, but are substantially similar to those shown associated with turbocharger 126.

The turbines 132 and 144 may be driven by exhaust gases from the engine, thereby driving the compressors 130 and 142 via the respective drive shafts 134 and 146. The compressors may be configured to compress intake air delivered to the cylinders, thereby providing boost to the engine. It will be appreciated that alternate turbocharger configurations may be used in other examples. For example, the central turbocharger arrangement may include a single compressor coupled by shafts to two centrally positioned turbines with turbine outlets facing each other between the banks of engine 100.

Further, the positioning of components of the turbochargers positioned between the banks of the engine may depend on the positioning of a configuration of the engine and various positions of components of the engine. In one example, the first and second turbochargers may be positioned at a same distance and along the same axes parallel to the crankshaft above the valley of the engine. In another example, the first turbocharger, or one or more components thereof, may be positioned at a first distance above the valley and the second turbocharger, or one or more components thereof, may be positioned at a second distance different from the first distance above the valley of the engine.

In some examples, one or more compressor bypass passages and/or compressor bypass valves may be provided. As shown in FIG. 1, a first compressor bypass passage 137 and compressor bypass valve 139 may be provided for enabling intake air to bypass compressor 130. Similarly, a second compressor bypass passage 127 and compressor bypass valve 129 may be provided for enabling intake air to bypass compressor 142. In this way, the amount of air flowing through compressors 130 and 142 may be individually controlled by varying the amount of bypass air via valves 139 and 129, respectively. In other examples, a single compressor bypass passage and associated bypass valve (e.g., a surge valve) may be provided to enable the intake air to bypass both compressors via a common bypass passage. The position of bypass valves 139 and 129 may be individually controlled via a control system 180 to vary the flow rate of intake air through passages coupled to the inlets of compressors 130 and 142, respectively.

Furthermore, exhaust turbine bypass passages and/or turbine bypass valves may be provided. Such turbine bypass valves will be described herein as wastegate valves so that they may be more easily distinguished from the compressor bypass valves described above. As shown in FIG. 1, a first wastegate valve 123 may be provided along turbine bypass passage 121 for enabling exhaust gases to bypass turbine 132. Similarly, a second wastegate valve 133 may be provided along turbine bypass passage 131 for enabling exhaust gases to bypass turbine 144. In this way, the amount of exhaust gases flowing through turbines 132 and 144 may be individually controlled via control system 180 to vary the amount of exhaust gases flowing through wastegate valves 123 and 133, respectively.

In some examples, the turbines may be variable geometry turbines configured to adjust the geometry (e.g. turbine inducer flow area or nozzle angle) of the turbine based on vehicle operating conditions. In this way, boost may be provided to the engine over a wide range of operating conditions (e.g. engine speeds, loads, etc.), increasing the vehicle's performance. The variable geometry turbine may include an actuator (e.g. membrane actuator, electric servo actuator) configured to adjust the geometry of the turbine. Suitable variable geometry turbines include an adjustable vane turbine and an adjustable nozzle turbine. If a variable geometry turbine is utilized the wastegate valves and bypass conduits may not be included in engine 100 or vice-versa, in some examples. However, in other examples a fixed geometry turbine may be utilized. When a fixed geometry turbine is utilized, the wastegate valves configured to adjust the turbo speed through a turbine bypass conduit coupled upstream and downstream of the turbine may also be included in the turbocharger system. However, in other examples, both a wastegate and variable geometry turbine may be included in the turbocharger system. However, in other examples, just the wastegate or the variable geometry turbine may be included in the turbocharger system and a fixed or variable geometry compressor may be utilized. It will be appreciated that the turbocharger system may be operated to provide varying levels of boost during various operating conditions. For example, the geometry of the turbine and/or the exhaust gas provided to the turbine may be adjusted to alter the amount of boost provided by the turbocharger system.

An intermediate passage 154, e.g., a common conduit, may couple the central-facing turbine outlets 138 and 150 of the first and second turbochargers together. Since the turbine outlets may be facing each other in a center portion of the engine between the banks, coupling the turbine outlets in this way may reduce the amount of ducting required to direct exhaust gas out of the engine. Intermediate passage 154 may include a junction 156. Junction 156 may be any type of junction which combines the exhaust from the outlets of the turbines into a common conduit and routes the exhaust from the turbines down through the valley of the engine. For example, junction 156 may include a T-joint or similar type ducting.

The exhaust from the turbines may be routed via junction 156 downwards toward the valley 106 via a common exhaust conduit 158. Conduit 158 may be positioned below the turbochargers within the valley of the engine and may pass beneath one of the turbochargers to exit the engine. For example, conduit 158 may pass below turbocharger 128 to exit the engine at end 110. Once exhaust conduit 158 exits the engine, it may be coupled with an exhaust aftertreatment system or vehicle tailpipe, for example.

Air may enter the engine via conduit 160 positioned at end 108 of engine 100. For example, air may enter conduit 160 after passing through an air filter. Conduit 160 may include a branch point 162 which splits conduit 160 into a first branch 164 coupled to the inlet 136 of compressor 130 and a second branch 166 coupled to the inlet 148 of compressor 142. In this way, air may be directed to the inlets of both compressors 130 and 142. Since the inlets of the compressors may face towards opposing ends of the engine, conduit 160 may include ducting positioned above a top surface of the engine. For example, conduit branch 166 of conduit 160 may be positioned above bank 102 so as to deliver air to inlet 148 of compressor 142. Alternatively, the positioning of the branches 164 and 166 of intake conduit 160 may depend on a configuration of engine 100. For example, branch conduits 164 and 166 may be positioned above, below, and/or around various engine components before being coupled to the respective compressor inlets 136 and 148.

Compressor outlets 168 and 172 of compressors 130 and 142, respectively, may face toward a common bank of the engine. For example, FIG. 1 shows the compressor outlets 168 and 172 facing toward bank 104. In another example, the compressor outlets may both face toward bank 102. In this way, the outlets 168 and 172 of compressors 130 and 142 may be coupled to a common conduit or passage 170. Conduit 170 may be positioned above the bank of the engine towards which the compressor outlets are facing. For example, when the compressor outlets both face toward bank 104, as shown in FIG. 1, conduit 170 may be positioned above bank 104. Furthermore, common conduit 170 may be positioned and/or routed above exhaust manifold 120. In other examples, the positioning of conduit 170 may depend on a particular engine configuration. For example conduit 170, may be positioned below exhaust manifold 120.

Compressed air exiting the compressors via conduit 170 may be split into a first branch conduit 175 and a second branch conduit 177 at a branch point 174. The branch point may be located adjacent to an end of the engine above a bank of the engine, e.g., adjacent to end 110 and above bank 104. The first and second branch conduits 175 and 177 may be coupled to the first and second intake manifolds 118 and 122, respectively. In this way, compressed air from the compressor outlets may be delivered to both intake manifolds on the opposing banks of engine 100. Since the common compressor output conduit 170 may be positioned above a common bank of the engine, branch conduit 175 may be positioned around and/or above various engine components so as to be coupled with intake manifold 118. In another example, junction 174 may be positioned along conduit 170 between the couplings with the compressor outlets. In this case, the branch conduits 175 and 177 may be positioned and/or routed above and/or around various engine components in order to be coupled with the respective intake manifolds.

Control system 180 is shown receiving information from a plurality of sensors 184 and sending control signals to a plurality of actuators 186. As one example, sensors 184 may include mass air flow (MAF) sensors, temperature sensors and various other sensors coupled to engine and/or exhaust components. Other sensors such as pressure and temperature sensors may be coupled to various locations in the vehicle. As another example, the actuators may include fuel injectors, e.g. fuel injector 320, valve actuators, wastegate and bypass valve actuators and various others. The control system 180 may include a controller 182. The controller may receive input data from the various sensors, process the input data, and trigger the actuators in response to the processed input data based on instructions or code programmed or encoded therein corresponding to one or more routines. In one example, controller may be a microcomputer, including microprocessor unit, input/output ports, an electronic storage medium for executable programs and calibration values, random access memory, keep alive memory, and a data bus.

An example turbocharger 126 is shown in detail in FIG. 2. Cylinders 304 and 306, shown in FIG. 2, among other cylinders of the engine, may be identical in some examples and may include identical components. As such, cylinder 304 will be described in greater detail. Additionally, turbocharger 128 will not be explained in FIG. 2 but can be understood to be substantially the same.

With reference to FIG. 2, cylinder 304 includes a combustion chamber 308 defined by combustion chamber walls 311. A piston 312 is moveably disposed within combustion chamber 308 and is coupled to a crankshaft 314 via a crank arm 316. Below crankshaft 314 is oil sump 310 which is configured to collect oil as it drains out of engine 100 where it serves to lubricate and cool elements of engine 100 including crankshaft 314. Cylinder 304 can include a spark plug 318 for delivering an ignition spark to combustion chamber 308. However, in some examples, spark plug 318 may be omitted, for example, where engine 100 is configured to provide combustion by compression ignition. Combustion chamber 308 may include a fuel injector 320, which in this example is configured as a port based fuel injector. However, in other examples, fuel injector 320 can be configured as a direct in-cylinder injector.

Cylinder 304 can further include at least one intake valve 322 actuated via an intake valve actuator 324 and at least one exhaust valve 326 actuated via an exhaust valve actuator 328. Cylinder 304 can include two or more intake valves and/or two or more exhaust valves along with associated valve actuators. In this particular example, actuators 324 and 328 are configured as cam actuators, however, in other examples, electromagnetic valve actuators (EVA) may be utilized. Intake valve actuator 324 can be operated to open and close intake valve 322 to admit intake air into combustion chamber 308 via intake port 114 communicating with intake manifold 118 (shown in FIG. 1). Similarly, exhaust valve actuator 328 can be operated to open and close exhaust valve 326 to exhaust products of combustion from combustion chamber 308 into exhaust port 112 and then to exhaust manifold 116. In this way, intake air may be supplied to combustion chamber 308 via intake port 114 and products of combustion may be exhausted from combustion chamber 308 via exhaust port 112.

Exhaust gases from engine bank 102 lead via exhaust manifold 116 to turbine inlet 140 where they enter turbine 132 to power turbocharger 126 supported by turbocharger mount 317. Turbine 132 is connected to compressor 130 via shaft 134 (shown in FIG. 1) to provide rotation suitable to compress air. Air enters compressor 130 at compressor inlet 136.

Oil used throughout turbocharger 126 to lubricate and cool turbocharger components including the turbine and bearing housing (shown in FIG. 3) drains out of turbocharger 126 into oil sump 310 via oil drain 295. Oil drain 295 exits turbocharger 126 and enters the valley 106 of the V-type engine, then winds through the cylinder block to reach oil sump 310. Oil drain 295 bypasses ducting, including junction 156 which joins turbocharger 126 and turbocharger 128 (shown in FIG. 1). Because of the narrow space available for oil drain 295, the drain piping may necessarily be of narrow diameter. High temperatures in the turbocharger discussed above produce hot oil that is susceptible to coking. Coking in a narrow diameter oil drain may lead to restriction of oil flow and inhibition of lubrication and cooling within the turbochargers 126 and 128. The present disclosure provides a coolant jacket 400 around oil drain 295 which is further detailed in FIG. 4. The coolant jacket 400 circulates coolant that may draw heat from the hot oil within oil drain 295 and mitigates the probability of oil coking as well as resulting in lower oil temperatures in oil sump 310. This cooler oil may be returned to turbochargers 126 and 128 and other components of engine 100 with greater lubricating and cooling capacities.

Variations in the path of oil drain 295 and coolant jacket 400 are possible. Dependent on the space confines of a particular engine block or needs of a particular engine, routing of oil drain 295, coolant jacket 400, oil passage 286, and coolant passage 266 may be different. Coolant passage outlet 255 may enter the engine block 185 in many regions or in the cylinder head, or in an alternate embodiment, be isolated from engine block 185 as part of a closed, turbocharger coolant system. Likewise, oil passage 286 may be fed via oil inlet 245 which may be arranged in varied positions throughout the engine block. Additionally, the passages need not flow through, or to, a specific engine bank as depicted in FIG. 2 but may be varied in their orientation to suit the needs of differing engine, manifold, or turbocharger configurations.

It should be appreciated that cylinder 306 or other cylinders of engine 100 can include the same or similar components of cylinder 304 as described above. Furthermore, it should be understood that the banks 102 and 104 may include any number of cylinders, for example 4, 8, or 12 cylinders.

FIG. 3 shows a cut-away view of an example embodiment of turbocharger 126. It is understood that turbocharger 126 shown in FIG. 1 may be substantially the same, possibly differing in orientation. Also, an engine may contain a single turbocharger. Turbine 132 converts the energy of the exhaust gas into rotational energy for rotating drive shaft 134 connected to impeller 240. Exhaust gas from exhaust manifold 116 enters turbine housing 280 through turbine inlet 140. The exhaust gas flows through a volute passage indicated by 282*a* and 282*b*. The flow of exhaust gas through turbine 132 generates a force on blade 270 coupled to hub 290 causing blade 270, hub 290, and drive shaft 134 to rotate. Drive shaft 134 is supported by bearings in bearing housing 275. These bearings can be either sleeve or ball bearings. Two blades, 270*a* and 270*b*, are shown for turbine 132, but one skilled in the art will appreciate that more blades may be present in turbine 132. Lubricating oil is supplied to bearing housing 275, blade 270 and other moving parts in turbocharger 126 via oil passage 286 that feeds oil reservoir 243, seen here as two lobes of a single reservoir surrounding drive shaft 134. Oil leaves turbocharger 126 via oil drain 295 shown in greater detail in FIG. 4.

Components within the turbocharger bearing housing are also cooled by coolant which enters the turbocharger bearing housing 275 via coolant jacket 400 flowing into coolant reservoir 244. Coolant reservoir 244 is seen in the cut-away view as two lobes of the reservoir which surrounds drive shaft 134. Coolant leaves coolant reservoir 244 via coolant passage 266 which flows toward coolant passage outlet 255 where it enters the engine block 185 to feed coolant to components within the engine 100.

Compressor 130 includes impeller 240, diffuser 230, compressor chamber 222, active casing treatment 210, and casing 220. The rotation of impeller 240, draws gas into compressor 130. As non-limiting examples, the gas may include air drawn from an exterior air passage, exhaust gas (such as when using long loop EGR), gaseous fuel (such as when using port injection of fuel), and combinations thereof. Gas flows from compressor inlet 136 and is accelerated by impeller 240 through diffuser 230 into compressor chamber 222. Diffuser 230 and compressor chamber 222 decelerate the gas causing an increase in pressure in compressor chamber 222. Gas under pressure may flow from compressor chamber 222 to intake manifolds 122 and 118.

Impeller 240 includes hub 254 and blade 250. It should be understood that blade 250 may have a variety of configurations including varieties in shape or number of fins. Impeller 240 includes an axis of rotation aligned with the axis of rotation for drive shaft 134 and turbine hub 290. The axis of rotation is substantially parallel with the flow of gas at the compressor inlet and substantially perpendicular to the flow of gas at the diffuser.

Casing 220 includes compressor inlet 138, intake passage 204. Intake passage 204 may be substantially cylindrical.

Referring now to FIG. 4, a preferred embodiment of the coolant jacket for turbocharger 128 (shown in FIG. 3) is depicted. Like reference numerals are used in FIG. 4 as in FIGS. 1-3. FIG. 4 shows bearing housing 275 in the vicinity of oil drain 295 that enters into the valley 106 of a V-type engine. The oil drain 295 includes an inlet in fluidic communication with the turbocharger bearing housing 275 (shown in greater detail in FIG. 3) and an outlet in fluidic communication with an oil sump 310 (shown in FIGS. 1 and 2). In this example, the oil drain is arranged between exhaust conduits of exhaust manifolds 116 and 120. Oil drain 295 may be of narrow diameter to fit within the space available in the valley 106 in the middle of engine banks 102 and 104. For this reason, overheating of oil within oil drain 295 may result in coking and residue build up which may restrict oil drain 295 and inhibit lubrication and oil cooling within the turbocharger.

Coolant jacket 400 is located around the oil drain 295 to cool the oil within the oil drain 295. Coolant jacket 400 may be coaxial to oil drain 295 and may extend along an entire length of the oil drain. In an alternate embodiment the coolant jacket may be confined to a section of the oil drain and not extend along the entire length of the oil drain.

Furthermore the coolant jacket may not circumferentially envelope the oil drain and may be disposed partially around the oil drain.

The coolant jacket 400 is suitable to carry a water-based or other type of coolant which may draw out and dissipate heat from the oil in oil drain 295. The coolant jacket may be suitable to cool the oil temperature of oil within the oil drain to below a threshold temperature at which oil coking occurs. The direction of coolant flow within the coolant jacket may be counter to a direction of oil flow within the oil drain as shown in FIG. 4. The coolant jacket may provide the coolant for a bearing housing for the turbocharger and may furthermore be the only fluid line providing coolant to the bearing housing for the turbocharger. The coolant jacket may circulate coolant to the coolant circuit for engine 100 and may, alternatively, be a closed system, servicing only turbocharger 126, or both turbochargers 128 and 126.

Figure 5:
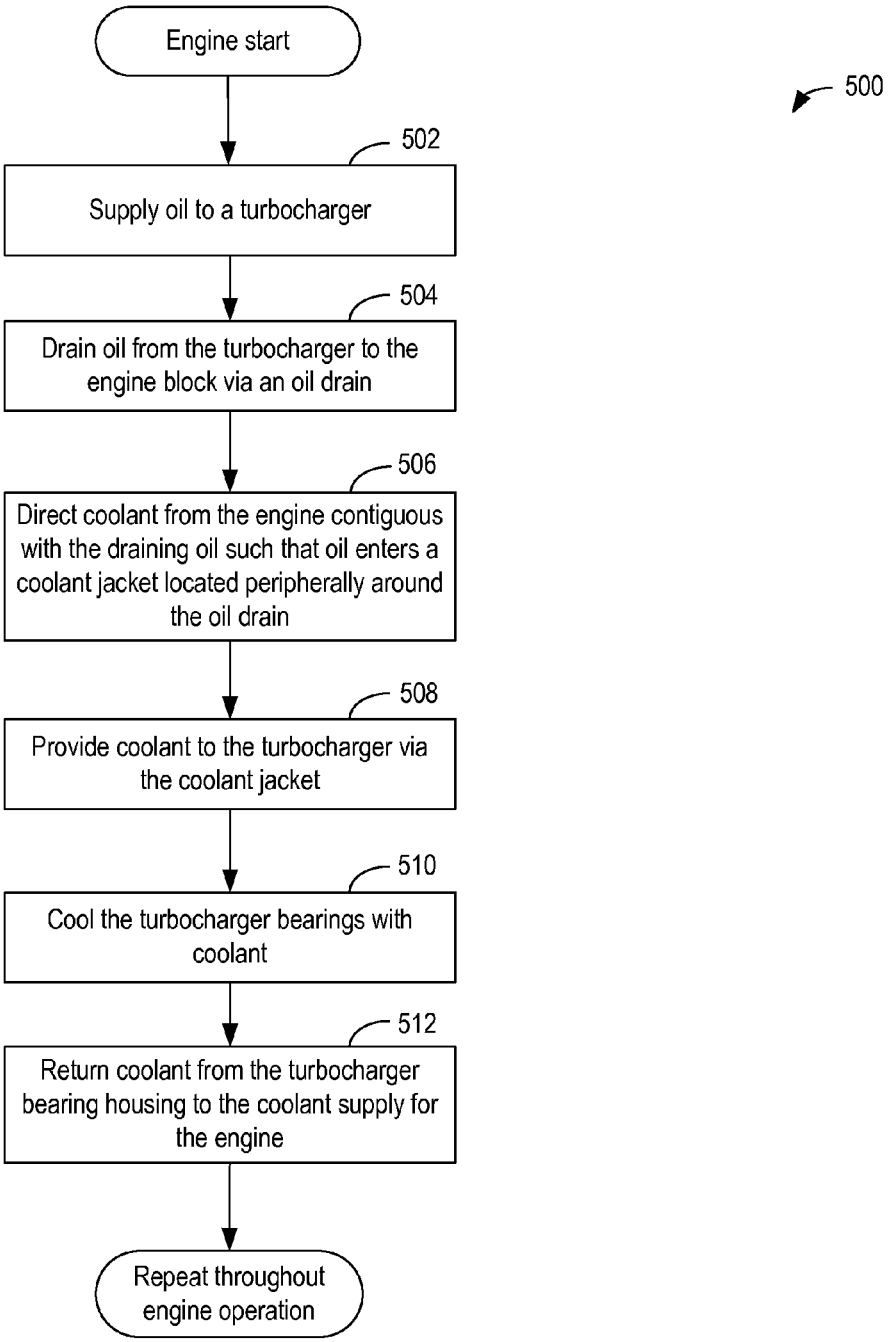
FIG. 5 shows a method in which coolant and oil flow through a turbocharger.

In reference to FIG. 5, a method by which coolant and oil flows through the turbocharger to cool and lubricate components within a turbocharger and additional elements throughout an engine is shown. Method 500 starts with an engine start and progresses to step 502 where oil is supplied to a turbocharger. Oil is supplied to the turbocharger via oil passage 286 which is fluidically coupled to an oil circuit of the engine. Oil is used to cool and lubricate spinning components of a turbocharger, such as turbocharger 126 described above. Oil is drained from the turbocharger 126 to the engine block 185 via an oil drain 295 at step 504. While oil is draining from the turbocharger, coolant is directed from the engine 100 containing the turbocharger 126 to the coolant jacket 400 located peripherally around the oil drain 295 at step 506. At step 508, the coolant jacket 400 provides coolant to the turbocharger 126. At 510, the coolant provided to turbocharger 126 is used to cool the turbocharger bearings in bearing housing 275. Coolant is directed from the turbocharger bearing housing 275 to the coolant supply for the engine via coolant passage 266 at step 512.

The method 500 of providing coolant and oil to a turbocharger is repeated throughout operation of the engine 100. Furthermore, it should be understood that though described in sequence the steps of method 500 may occur simultaneously throughout engine operation. Additionally, the method 500 was described in terms of turbocharger 126 but also applies to operation of turbocharger 128, or any additional. Additionally, the coolant jacket 400 as described in method 500 is located peripherally around the oil drain 295. The oil jacket of the present disclosure can assume a variety of configurations in relation to the oil drain such that it is suitable to draw heat from the hot oil within the oil drain and may include being located partially around the oil drain or, alternatively, enveloping the oil drain in a confined region and not along its entire length.

The present disclosure describes a system including a turbocharger, comprising: a turbocharger bearing housing supporting a turbocharger drive shaft; an oil drain including an inlet in fluidic communication with the turbocharger bearing housing and an outlet in fluidic communication with an oil sump; and a coolant jacket enveloping the oil drain. The method of directing coolant through the coolant jacket and draining oil through the oil drain allows for the coolant to draw heat from the oil within the oil drain and mitigate coking of hot oil. The coolant jacket has the advantage of cooling the oil draining out of the turbocharger reducing the likelihood of coking within the oil drain but also of decreasing the temperature of oil within the oil sump. The coolant jacket may be useful in drawing heat from the oil as it drains from the turbocharger, but may also be constructed to provide coolant to the turbocharger, and further integrated into the broader coolant circuit of the engine. The cooling jacket may assume a variety of structures on the outside of the oil drain and may extend the length of the oil drain or may be confined to a section of the oil drain.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

supplying oil to a turbocharger from an engine block of a V engine with inbound exhaust conduits, the turbocharger positioned between banks of the V engine;

draining oil from the turbocharger back to the engine block via an oil drain extending from the turbocharger to an oil sump; and directing coolant from the V engine to the turbocharger, through a coolant jacket located peripherally around a region of the oil drain external to a turbocharger housing, wherein the coolant jacket is coaxial with the region of the oil drain external to the turbocharger housing.

2. The method of claim 1, wherein directing coolant includes directing coolant while draining the oil from the turbocharger and wherein directing coolant to the turbocharger includes directing coolant through a coolant passage through a turbocharger bearing housing to cool the turbocharger bearing housing.

3. The method of claim 2, further comprising returning coolant from the turbocharger bearing housing back to a coolant supply of the V engine and wherein the coolant jacket extends along a length of the oil drain from the turbocharger to the oil sump.

4. The method of claim 2, wherein the region of the oil drain external to the turbocharger is external the turbocharger housing, and wherein directing coolant through the coolant jacket includes directing coolant in a first direction through the coolant jacket while flowing oil in a second direction, opposite the first direction, through the region of the oil drain.

5. The method of claim 1, wherein the draining oil passes between a first and a second exhaust manifold of a first and a second engine bank of the V engine and wherein during the draining oil from the turbocharger, oil exits the turbocharger via an inlet of the oil drain which is in fluidic communication with the oil sump at an outlet of the oil drain.

6. The method of claim 1, wherein the draining oil drains in a direction opposite a flow of the directed coolant, wherein supplying oil to the turbocharger includes flowing oil from an oil passage fluidly coupled to an oil circuit of the engine block to an oil reservoir within a bearing housing of the turbocharger, through the oil reservoir, and then draining oil from the turbocharger via the oil drain, and further comprising directing coolant from the coolant jacket to a coolant reservoir within the bearing housing, and then to a coolant passage which flows coolant to the engine block to feed coolant to components within the V engine.

7. A system including a turbocharger, comprising:

a turbocharger bearing housing supporting a turbocharger drive shaft;

an oil drain including an inlet in fluidic communication with the turbocharger bearing housing and an outlet in fluidic communication with an oil sump; and a coolant jacket circumferentially enveloping an outside of the oil drain in a region of the oil drain exterior to the turbocharger, wherein a direction of a flow of coolant within the coolant jacket is counter to a direction of flow of oil through the oil drain.

8. The system of claim 7, wherein the turbocharger is positioned in a valley between a first engine bank and a second engine bank of an engine coupled to the turbocharger, wherein the oil sump is positioned in an engine block of the engine, wherein the oil drain extends between the turbocharger bearing housing and the oil sump, and wherein the region of the oil drain exterior to the turbocharger is exterior to a housing of the turbocharger.

9. The system of claim 8, wherein the oil drain is positioned between a first exhaust conduit of the first engine bank and a second exhaust conduit of the second engine bank and wherein the oil drain exits the turbocharger and enters the valley, and then winds through the engine block to reach the oil sump.

10. The system of claim 9, wherein at least segments of the coolant jacket are adjacent each of the first and second exhaust conduits, wherein the first and second exhaust conduits are first and second exhaust manifolds of the first engine bank and the second engine bank.

11. The system of claim 7, wherein the coolant jacket is in fluidic communication with a coolant circuit of and engine via an engine block, wherein the oil drain is in fluidic communication with an oil circuit of the engine block.

12. A system for a turbocharger, comprising:

a pressure fed oil inlet providing oil to the turbocharger;

an oil drain to drain the oil from the turbocharger; and a coolant jacket located around a circumference of an outside of the oil drain at a region of the oil drain located exterior to the turbocharger wherein the region of the oil drain located exterior to the turbocharger housing extends along an entire length of the oil drain between a turbocharger housing and an oil sump within an engine block.

13. The system of claim 12, further comprising a V engine including a first cylinder bank and a second cylinder bank, wherein the turbocharger is mounted in a valley formed between the first cylinder bank and second cylinder bank of the V engine.

14. The system of claim 13, wherein the oil drain is located between a first exhaust manifold of the first cylinder bank and a second exhaust manifold of the second cylinder bank, and an inlet of the oil drain is in fluidic communication with turbocharger bearings and an outlet of the oil drain is in fluidic communication with an oil sump.

15. The system of claim 14, wherein the coolant jacket located around the circumference of the outside of the oil drain is confined to a section of the oil drain, where the section is exterior to the turbocharger and between the first and second exhaust manifolds.

16. The system of claim 12, wherein the coolant jacket located around the circumference of the outside of the oil drain is fluidically coupled to a coolant reservoir within a bearing housing for the turbocharger.

17. The system of claim 16, wherein the coolant jacket is an only coolant supply to the turbocharger.

18. The system of claim 16, further comprising a coolant passage fluidically coupled to the coolant reservoir within the bearing housing to a coolant circuit for a V engine.

19. The system of claim 12, wherein the coolant jacket is coaxial to the oil drain.

* * * * *